US008082821B2

(12) United States Patent
Wise et al.

(10) Patent No.: US 8,082,821 B2
(45) Date of Patent: Dec. 27, 2011

(54) TOOL FOR USE WITH SKI BOOTS, BINDINGS AND BOARDS

(75) Inventors: Frederick M. Wise, Golden, CO (US); Alex M. Wise, Arvada, CO (US); Brett M. Wise, Arvada, CO (US)

(73) Assignee: A.B.M. Fabrication & Machining, LLC, Arvada, CO (US)

( * ) Notice: Subject to any disclaimer, the term of this patent is extended or adjusted under 35 U.S.C. 154(b) by 880 days.

(21) Appl. No.: 12/130,804

(22) Filed: May 30, 2008

(65) Prior Publication Data

US 2008/0290121 A1 Nov. 27, 2008

Related U.S. Application Data

(63) Continuation-in-part of application No. 12/091,986, filed on Apr. 29, 2008, now abandoned.

(60) Provisional application No. 60/732,173, filed on Nov. 1, 2005.

(51) Int. Cl.
*B67B 7/44* (2006.01)
*B25B 27/00* (2006.01)

(52) U.S. Cl. ..... 81/3.09; 81/488

(58) Field of Classification Search ..... 81/3.09, 81/3.55, 488, 490; 7/151, 155, 165, 170
See application file for complete search history.

(56) References Cited

U.S. PATENT DOCUMENTS 1,953,690 A * 4/1934 Samways ..... 7/167
2,939,618 A 6/1960 Mangels
3,636,594 A 1/1972 Faivre
3,864,769 A 2/1975 Hamilton
3,902,226 A 9/1975 Messenbaugh
4,210,035 A 7/1980 White
4,235,269 A 11/1980 Kraus
4,250,595 A 2/1981 Byrnes
D258,920 S 4/1981 White
4,304,019 A 12/1981 Sava
4,537,436 A 8/1985 Pfortmiller
4,587,870 A 5/1986 Colburn
4,629,103 A 12/1986 Miller
4,696,504 A 9/1987 Roberts, Jr.
(Continued)

FOREIGN PATENT DOCUMENTS

CH 654 189 A 2/1986
(Continued)

OTHER PUBLICATIONS

Young, Lee W., International Search Report and Written Opinion, Aug. 21, 2008, Alexandria, Virginia, United States of America.

*Primary Examiner* — David B Thomas
(74) *Attorney, Agent, or Firm* — Holland & Hart LLP

(57) ABSTRACT

A tool for opening and closing a boot buckle that has a latching lever including a base portion and a longitudinally extending first working head with an opening sized to engage the latching lever. A tongue portion projects from the base portion into the opening, and this opening may be formed as an annulus. Teeth may be provided on the internal sidewall of the opening. A second working head may be provided with a socket portion thereon to mount a tool piece. A lidded compartment may be formed in the base portion. A cord may mount to the base portion.

37 Claims, 6 Drawing Sheets

U.S. PATENT DOCUMENTS

| | | | | | |
|---|---|---|---|---|---|
| 4,730,863 | A | | 3/1988 | Guadnola | |
| 4,815,642 | A | | 3/1989 | Ray | |
| 4,867,359 | A | | 9/1989 | Donovan | |
| 5,090,277 | A | * | 2/1992 | Spiller | 81/488 |
| 5,150,869 | A | | 9/1992 | Gould et al. | |
| 5,240,300 | A | | 8/1993 | Ramsey | |
| 5,259,281 | A | * | 11/1993 | Burke | 81/437 |
| 5,313,860 | A | * | 5/1994 | Liou | 81/437 |
| D347,558 | S | * | 6/1994 | Alonzo | D8/14 |
| 5,454,132 | A | | 10/1995 | Neves | |
| 5,535,644 | A | * | 7/1996 | Paul-Alexandre et al. | 81/3.09 |
| 5,771,759 | A | | 6/1998 | Warren | |
| 5,853,213 | A | | 12/1998 | Simpson | |
| 6,032,332 | A | | 3/2000 | Lin | |
| 6,151,741 | A | * | 11/2000 | Chen | 7/155 |
| D453,667 | S | | 2/2002 | Wishnick | |
| 6,454,335 | B1 | | 9/2002 | Wishnick | |
| 6,752,040 | B1 | * | 6/2004 | Paul-Alexandre et al. | 81/3.09 |
| 2006/0207390 | A1 | * | 9/2006 | Kehoe | 81/3.09 |
| 2007/0277336 | A1 | * | 12/2007 | Heaslet | 15/105 |

FOREIGN PATENT DOCUMENTS

| | | | |
|---|---|---|---|
| DE | 29 12 946 | A | 10/1980 |

* cited by examiner

TOOL FOR USE WITH SKI BOOTS, BINDINGS AND BOARDS

BACKGROUND OF THE INVENTION

The present invention is broadly directed to an apparatus to assist a skier while participating in his/her sport. The tool disclosed herein is particularly useful in assisting a skier in the buckling and unbuckling of ski boots. Some of the embodiments described herein also provide assistance in adjusting ski boot bindings. In addition, an embodiment is provided which may be used by a skier to treat the edges of a ski or snowboard. The tool also permits easy transport of a pair of ski boots. The tool may also be used, in certain circumstances, to open a beverage bottle.

As is well known, quick release latches are commonly used on ski boots. Such quick release latches typically have a clamping loop or cable secured to a first portion of the ski boot and an elongated buckle or lever pivotally secured to a second portion of the boot. A clamping loop or cable engages the boot at a desired location when in a release position. When pivoted to a fastened position, the buckle or lever draws the two ski boot portions together so as to clamp the boot around the foot of the skier. Often, manipulation of the buckle or lever requires exertion of significant force in order to achieve the desired clamping action. Conversely, releasing the buckle or lever also requires exertion of a counteracting force.

It is desirable that the profile of such ski boot buckles or latches be reduced as much as possible. Accordingly, there is often limited space available for the skier to gain purchase on the lever, especially when moving it from a fastened position to a released position. Grasping of the buckle lever can further be impeded by the presence of snow which may become compacted around the ski boot buckle during skiing. In addition, manipulation of the ski boot buckle or lever may be more difficult for older skiers or skiers with disabilities.

In addition, it is known that ski boot bindings are adjusted to allow a ski boot to release when torque forces on the ski boot exceed a certain magnitude. Such release, of course, is desirable to avoid injury to the skier. The threshold for the release force between the ski boot and the boot binding is typically set based on the skier's ability, weight and the type of terrain over which the skier intends to traverse. While the threshold level may be set at the outset of a skiing day, many skiers wish to adjust their bindings during a skiing event either because the release force has been set too low or too high for a selected terrain.

Another problem encountered by skiers during a skiing event is the dulling of the edges of a ski or a ski board. This can especially occur when the skier encounters rocks or debris on a ski slope where damage to the edge of the ski results from such contact. Skiers do not usually have available any means for repairing such damage during a particular outing.

Finally, the universal problem encountered by skiers is the transportation of their equipment. A skier typically must transport his/her skis or snowboard along with coats, gloves, hats or other clothing. In addition, the skier must transport his/her ski boots and often carries a daypack, fanny pack or other carrier in which to store personal items, food, etc. The transportation of ski boots is particularly awkward since there are few convenient places to grasp the ski boot and due to their weight.

Accordingly, there is a need for improved tools that may be used by skiers during a skiing event. There is a need for a tool which may be used in a variety of applications so as to assist a skier in adjusting his/her bindings and in repairing damage to the edges of a ski or snowboard or otherwise to fine tune the edges thereof in order to enhance the skiing event. In addition, there is a need for a ski tool which will assist skiers in the buckling and unbuckling of their ski boots as well as to assist the skiers in the transportation of such ski boots. The embodiments described herein are directed to meeting these needs.

OBJECTS AND ASPECTS

It is an object of the present invention to provide a new and useful tool for use in opening and closing boot buckles wherein such boot buckles include a latching lever.

One aspect of the exemplary embodiments of the present invention is to provide structure for mounting tool pieces that can be used, for example, on boot bindings and the like.

Another aspect of at least some of the exemplary embodiments is to provide a tool with a compartment for storing tool pieces for use in the repair and maintenance of ski boots and bindings.

Still a further aspect of some of the exemplary embodiments is to provide a tool that may also be used as a carrier for ski boots to facilitate transport thereof.

Yet another object of at least some of the exemplary embodiments is to provide structure to facilitate removing a cap from a beverage bottle.

A further aspect of at least some of the exemplary embodiments is to provide structure to facilitate the removal of a cork from a beverage bottle.

According to the present invention, then, a tool is provided with this tool being adapted for use in opening and closing boot buckles where such boot buckles include a latching lever. Examples of such boot buckles include ski boots, snow boots, and the like. According to the broad form of the invention, the tool includes a base portion and a first working head that projects longitudinally from the base portion. This first working head has an opening formed therein that is sized and adapted to engage a latching lever of a boot buckle. Moreover, the first working head is configured to provide a tongue portion projecting longitudinally away from the base portion to help engage the buckle lever.

According to some exemplary embodiments of the present invention, the base portion has a compartment formed therein with a compartment interior adapted to receive at least one tool piece therein. In some embodiments, the compartment is formed as an elongated channel in the base portion. In other embodiments, the compartment may be in the form of a rectangular chamber. Here, a cover member (i.e. a lid) may be provided to enclose the compartment when the cover member is in a mounted state. Also, in some embodiments, the cover member may include a recess formed therein. A label may be disposed in the recess and secured to the cover member, if desired.

Moreover, in some embodiments, the compartment has an interior surrounding sidewall and is formed to provide a ledge or shelf extending around the sidewall thereby to define a seat for the cover member. Here, the cover member includes a rim wall having a rim wall edge operative to engage this seat when in a mounted seat. A tool piece may then be disposed in the compartment.

In the exemplary embodiments described herein, the tool includes a second working head projecting longitudinally from the base portion opposite of the first working head. The second working head includes a socket portion adapted to supportively mount a tool piece, such as a tool piece stored in the compartment. In some embodiments, this socket portion is cup-shaped so as to have a cavity that is sized and adapted to receive an end portion of the tool piece. This cavity may be hexagonal in cross section and receive, for example, the head of a Philips screw bit, flathead screw bit, etc. A magnet may be disposed in the cavity to help retain the tool piece in the mounted state. In another embodiment, the socket portion has a bore formed therethrough that is sized and adapted to receive a medial portion of the tool piece.

In the exemplary embodiments, the first working head is formed generally as an annular portion defining the opening. Thus, the first working head includes a distal transverse bar section in opposed relation to the tongue portion. This annular working head may have a common thickness with the base portion. Here, also, the annular portion has an internal sidewall. At least one tooth structure, but preferably a plurality of opposed tooth structures, are formed on the internal sidewall. The tongue portion and the tooth structures may be respectively used to help pry off or twist off, respectively, caps of bottled beverages.

In some embodiments, the base portion includes an ear portion projecting therefrom with the ear portion having a hole formed therethrough that is adapted to receive a flexible cord. A flexible cord may then be secured to the base portion so that the flexible cord may be used to carry a pair of ski boots with the tool thereby forming a handle for the carrier. Optionally, the base portion may be covered with a soft grip material extending therearound to enhance the comfort to the human hand when gripping the tool.

These and other objects and aspects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

The present invention broadly relates to tools and is specifically directed to tools that may be used by skiers as an enhancement to their sport. The exemplary embodiments described herein are constructed so as to provide a device that aids a person in the buckling and unbuckling of ski boots. In addition, as may be appreciated from the following disclosure, additional aspects of some of these embodiments include the ability to help transport a pair of ski boots as well as to provide tools for adjusting ski bindings and for treating the edges of a ski or snowboard. It should be understood that the various differences among the exemplary embodiments described may be interchanged so that any feature of any embodiment may be incorporated into the other embodiments. Moreover, it should be appreciated while the present embodiments are directed to ski tools, such tool may have applications of use outside of the sport of skiing.

Figure 1:
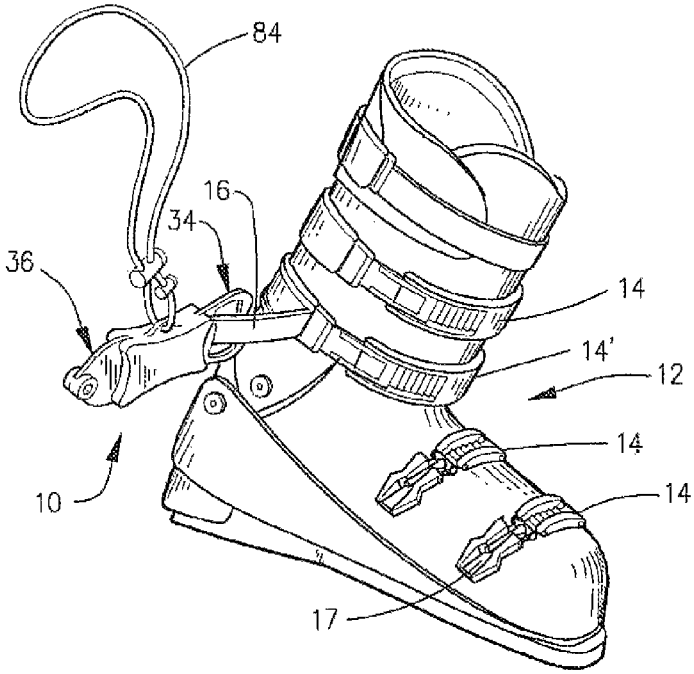
FIG. 1 is a perspective view of a representative ski boot and a ski tool according to a first exemplary embodiment of the present invention being used to facilitate buckling and unbuckling of the ski boot.

With such in mind, a first exemplary embodiment of a ski tool 10 according to the present invention is introduced in FIG. 1. Here, it may be seen that ski tool 10 is in a position for use in conjunction with a ski boot 12. As is known, a ski boot 12 includes one or more buckles or latches 14 which, when released, allow a skier to insert and remove his/her foot from the ski boot. When fastened, buckles 14 clamp the ski boot around the foot in a secure manner. Thus, as is shown in FIG. 1, four such buckles 14 are illustrated with three buckles being in a fastened state. The fourth buckle, which may be designated as buckle 14', is shown in a released state. As is known, buckles as buckle 14' includes a tensioning or latching lever 16 which is to be manipulated by the skier in both fastening and releasing the respective buckle. As is illustrated in FIG. 1, ski tool 10 engages lever 16 to allow a person to gain additional mechanical advantage both in fastening and unfastening such buckle 14'.

Figure 2:
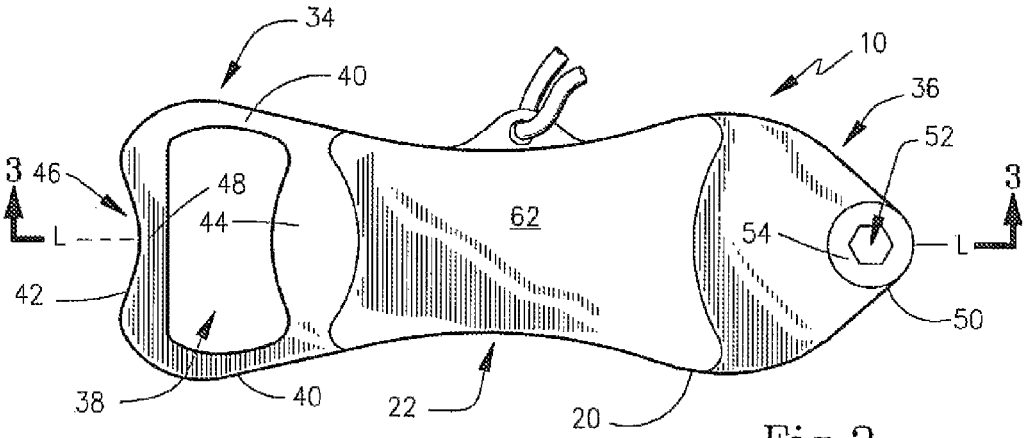
FIG. 2 is a top plan view of a ski tool according to the first exemplary embodiment of the present invention.
Figure 3:
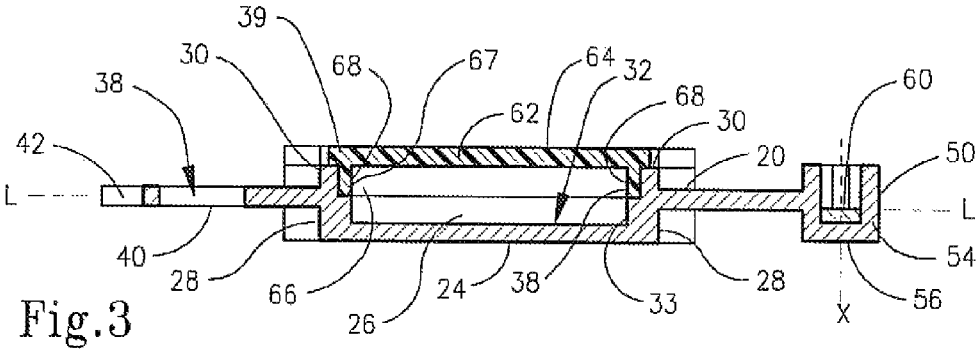
FIG. 3 is a cross-sectional view taken about lines 3-3 of FIG. 2.
Figure 4:
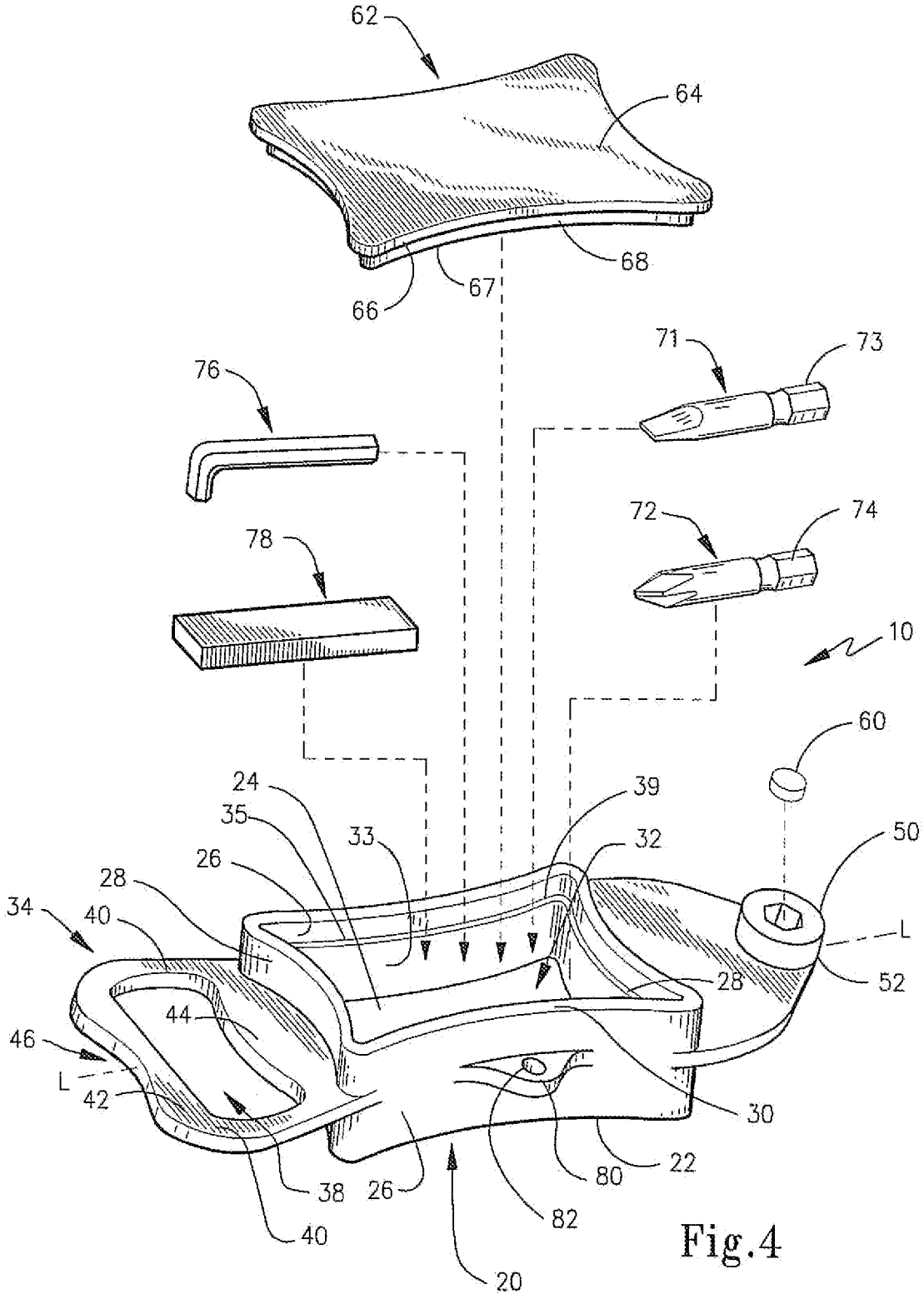
FIG. 4 is an exploded view in perspective of the ski tool of FIGS. 1-3.

The structure of ski tool 10 is further illustrated in greater detail in FIGS. 2-4. Here, it may be seen that ski tool 10 includes a base portion 20 that includes a compartment 22 having a bottom wall 24 a pair of sidewalls 26, a pair of end walls 28 and an upper rim 30 thereby to form an interior surrounding sidewall. Base portion 20 is generally in the form of a "figure 8" or hourglass such that it has a medial waist of reduced dimension. Thus, compartment 22 has an interior 32 with an open mouth. A ledge or shelf 33 extends around the bottom perimeter of compartment 22 proximately to bottom wall 24 in order to provide a shoulder 35 to engage rim wall edge 67 of lid 62 thereby defining a seat therefor. An optional rib 39 extends around the upper perimeter of compartment 22 to help provide a friction fit for lid 62. Base portion 20 may be constructed of metal, either cast or machined, or may be constructed of any other suitably strong plastic or composite material, such as a glass reinforced nylon, etc.

In any event, as is shown in these figures, a first working head 34 projects longitudinally from base portion 20 along longitudinal axis "L". A second working head 36 also projects longitudinally of base portion 20 oppositely of first working head 34. First working head 34 includes a contoured opening 38 formed therein so as to be formed generally in an annular shape that includes a pair of opposed arms 40 and a transverse distal bar section 42 extending therebetween. Opening 38 is sized and adapted to receive the end of a buckle lever such as buckle lever 16, as is shown in FIG. 1. Opening 38 is configured so as to provide a tongue portion 44 that projects longitudinally away from base portion 20 into opening 38. Tongue 44 helps engage lever 16. In addition, as is best illustrated in FIG. 2, bar 42 may include an arcuate cutout 46 that is aligned with tongue 44 along longitudinal axis "L". Cut out region 46 is provided to facilitate insertion of bar 42 between a ski boot lever 16 and a ski boot when such lever is in a fastened state. Thus, bar 42 tapers with a reduced dimension from arms 40 to its midpoint 48.

As noted above, second working head 36 projects oppositely of first working head 34 and includes a socket portion 50 at its distal end. Socket 50 is a generally cylindrical, cup-shaped member having a hexagonal cavity 52 formed therein along axis "X". Accordingly, socket 50 includes a surrounding sidewall 54 and a bottom wall 56. Hexagonal cavity 52 is sized and adapted to receive an end portion of a tool piece such as the head of a tool bit, as described more thoroughly below. Moreover, in order to help secure such tool bit within socket 50, a small magnet 60 is disposed in cavity 52 adjacent bottom wall 56 and may be retained therein by an adhesive or any other convenient technique.

A cover member or lid 62 is provided to enclose interior 32 of compartment 22 when in a mounted state. Lid 64 is illustrated in FIGS. 2-4. Here, it may be seen that lid 62 includes a central plate 64 that is contoured to the shape of base piece 20 and upper rim 30. A rim wall 66 projects from one side of central plate 62 so as to downwardly depend therefrom and terminate in a rim wall edge 67. Rim wall 66 is sized for a friction fit within the mouth of interior 32 so that it frictionally engages sidewalls 26 and end walls 28. To this end, rim wall 66 and central plate 64 form a shoulder 68 that defines a seat for upper rim 30 of compartment 22. Rim wall edge 67 is operative to abut the seat formed by shelf Rim wall 66 and also presses against rib 39 to further enhance the friction fit. Lid 62 may constructed of plastic or other suitable material.

With reference now to FIG. 4, it may be seen that compartment 22 is provided to receive and store tool pieces that may be used, for example, by a skier. Lid 62, when in a mounted state, secures such tool pieces in compartment 22. For example, as is illustrated in FIG. 4, a flat head screwdriver bit 71 and a cross-point screwdriver bit 72 may be stored in interior 32 of compartment 22. Such screwdriver bits are known in the art. It should be appreciated that each bit 71, 72 includes a hexagonal head 73, 74, respectively that is sized for close fitted insertion into hexagonal cavity 52 so that base portion 20, in use, becomes a handle for driving the respective bit. Compartment 22 may also receive a small allen wrench 76 and, if desired, allen wrench 76 can be configured so as to have a head or otherwise be received in cavity 52. Finally, a small whetstone or file 78 may be received in compartment 22 so that a skier may have such whet stone available for treating the edge of his/her ski board or ski. Other objects or tool pieces may naturally be stored in this compartment.

Figure 5:
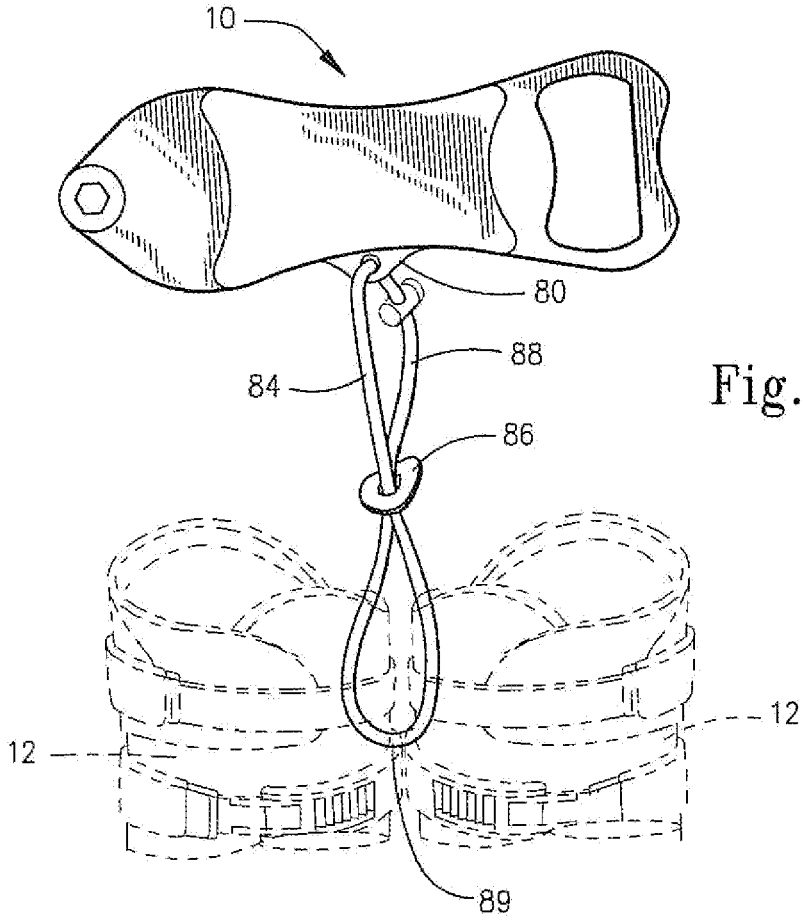
FIG. 5 is a perspective view showing the ski tool of FIGS. 1-4 in a position to assist in carrying a pair of ski boots which are shown in phantom.

With reference now to FIGS. 1, 4 and 5, it may also be seen that base portion 20 can include an ear 80 which, as is illustrated, projects from one of sidewalls 26 exteriorly of compartment 22. Ear 80 has a hole 82 formed therethrough and may receive any suitable flexible cord 84 to assist in carrying ski boots 12, as is illustrated in phantom in FIG. 5. If desired, a locking grommet or washer 86 can be provided to separate cord 84 into loops 88 and 89 and may be used to selectively shorten either of such loops.

Figure 6:
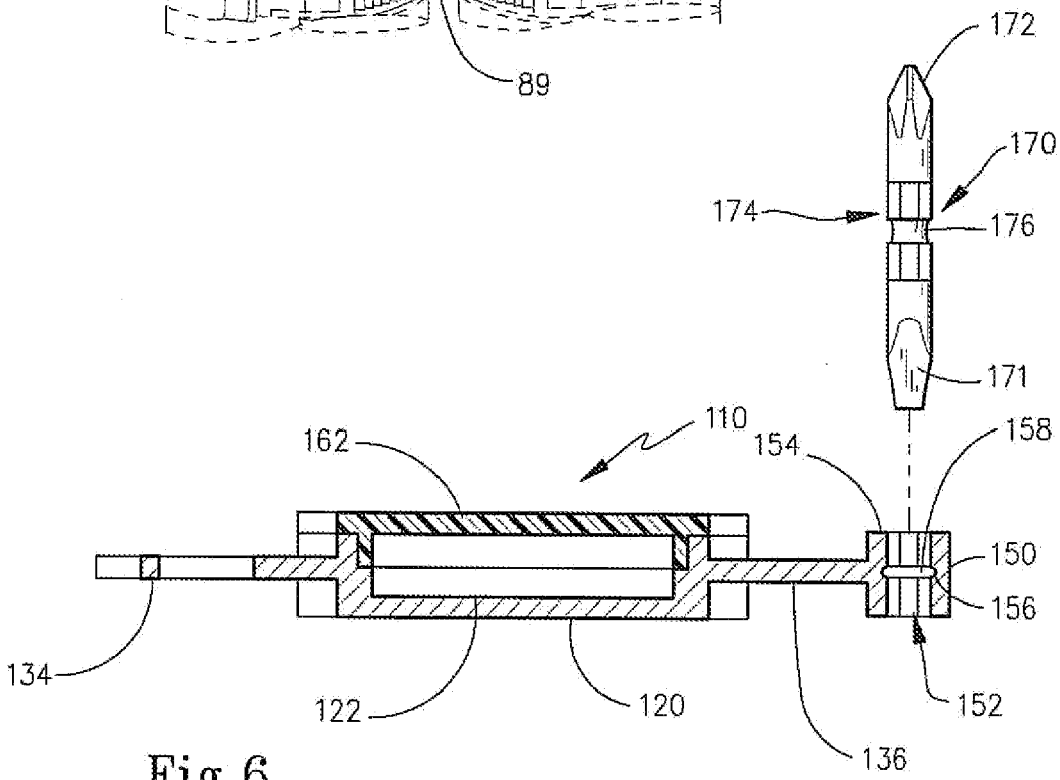
FIG. 6 is a side view in cross-section, similar to FIG. 3, showing a second embodiment of the present invention having a modified bit driver.

A second exemplary embodiment of the present invention is illustrated in FIG. 6. Here, ski tool 110 is constructed similarly to ski tool 10 so as to include base portion 120, first working head 134 and second working head 136. Base portion 120 forms a compartment 122 that is enclosed by a lid 162, as described above. Here, however, socket 150 does not have a bottom wall but rather has a hexagonal cavity or bore 152 extending completely therethrough. A central groove 156 is formed around the interior of sidewall 154 and an O-ring 158 is positioned therein. In this embodiment, flat screwdriver bit 71 and cross point screwdriver bit 72 may be provided by a single combination bit 170 having opposite ends 171 and 172 providing, respectively, the flat head screwdriver and the cross point screwdriver. A central mounting portion 174 is then provided medially on bit 170 so as to engage cavity 152 with a groove 176 sized and adapted to engage O-ring 158 to secure bit 170 therein.

Figure 7:
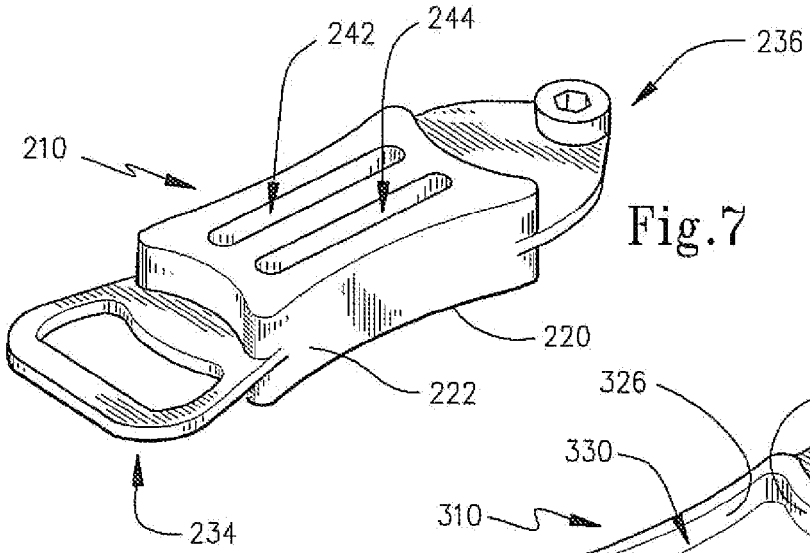
FIG. 7 is a perspective view of a third exemplary embodiment of the present invention.

A third exemplary embodiment of the present invention is illustrated in FIG. 7. Here, ski tool 210 is constructed similarly to ski tool 10 except that compartments are formed as longitudinal channels. Here, base portion 220 of ski tool 210 has an enlarged central portion 222. First working head 234 projects longitudinally from one end of central portion 222 while second working head 236 projects longitudinally from central portion 222 opposite first working head 234. Central portion 222 includes a pair of parallel, longitudinally extending channels or slots 242 and 244 that are sized and adapted to receive tool pieces, such as flat screwdriver bit 71 and cross head screwdriver bit 72 or combination bit 170 described above.

Figure 8:
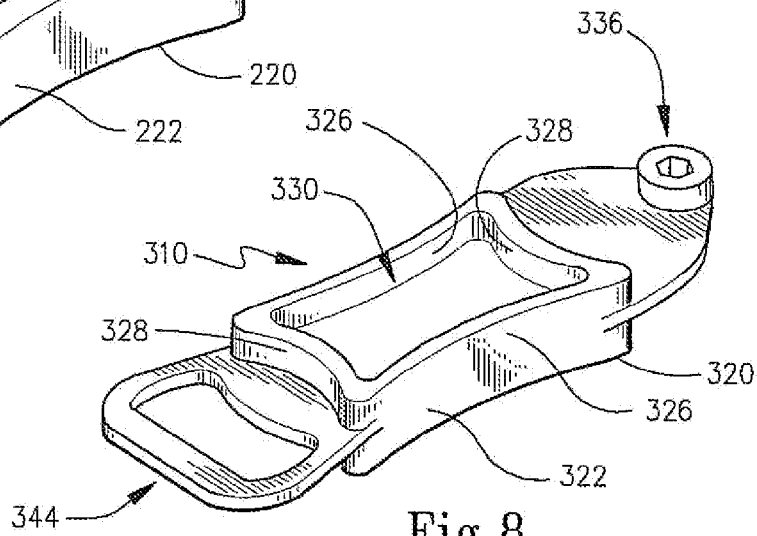
FIG. 8 is a perspective view of a fourth exemplary embodiment of the present invention.

A fourth exemplary embodiment of the present invention is illustrated in FIG. 8. Here, ski tool 310 again includes an enlarged base portion 320 from which first and second working heads 334 and 336 longitudinally project. Here, however, central portion 322 of base portion 320 has an enlarged opening 330 formed therein so that central portion 322 is defined as a hollow portion having sidewalls 326 and end walls 328. In this embodiment, therefore, material usage and weight is reduced.

Figure 9:
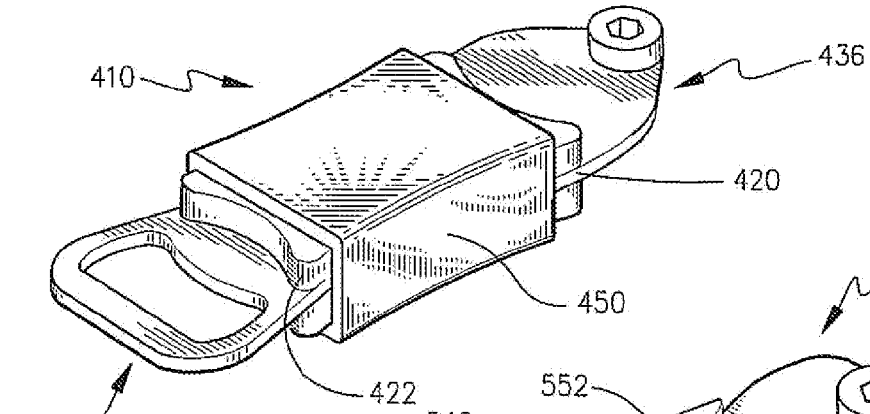
FIG. 9 is a perspective view of a fifth exemplary embodiment of the present invention.

A fifth exemplary embodiment of the present invention is illustrated in FIG. 9. Here, ski tool 410 is constructed similarly to those embodiments described above wherein a base portion 420 has working heads 434 and 436. Central portion 420 includes an overmolding layer 450 of any suitable material, such as a soft grip plastic, extending around base portion 420. In this embodiment, suitable cavities or slots may be provided in base portion 420, as is known in the art, to receive the overmold.

Figure 10:
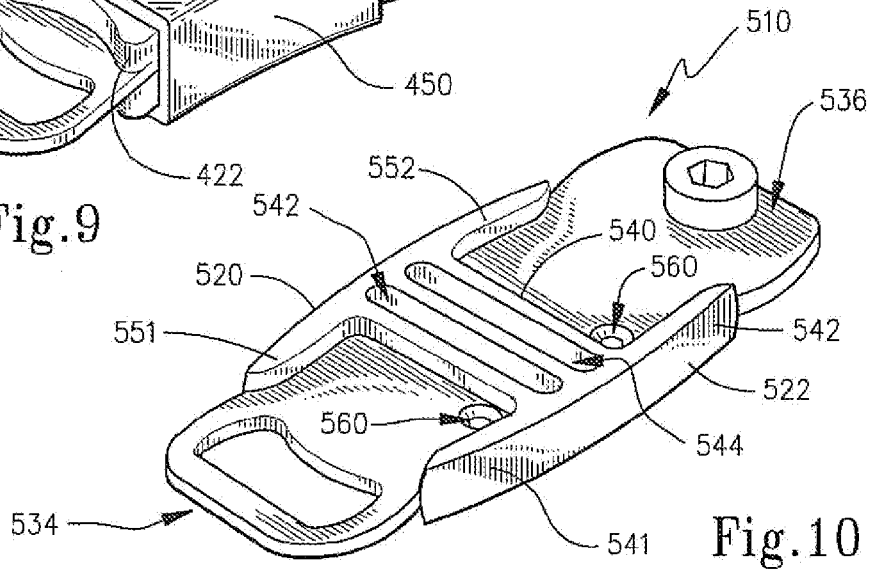
FIG. 10 is a perspective view of a sixth exemplary embodiment of the present invention.

A sixth exemplary embodiment of the present invention is illustrated in FIG. 10. Here, ski tool 510 includes a base portion 520 having a central section 522 having an h-shaped configuration. Accordingly, central section 522 has longitudinally extending leg sections 541 and 542 which are respectively opposed to leg sections 551 and 552. Medial portion 540 is provided with transverse, elongate channels or slots 542 and 544 to receive tool bits, as described above, and working heads 534 and 536 again project oppositely one another from central portion 522. Openings 560 are provided to receive a cord, such as cord 84, discussed above.

Figure 11:
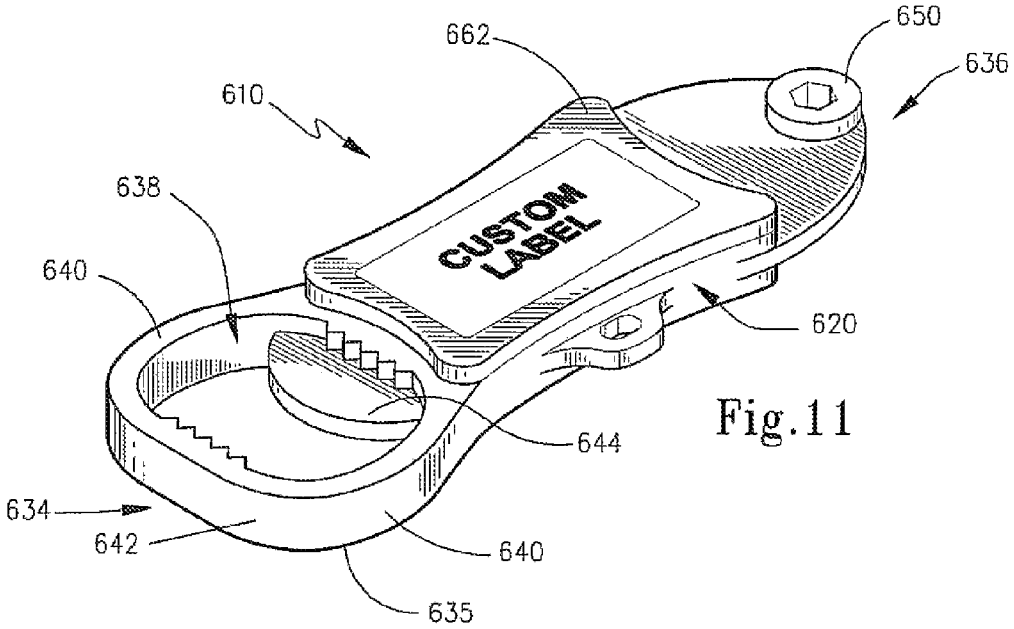
FIG. 11 is a perspective view of a representative ski boot and a ski tool according to a seventh exemplary embodiment of the present invention.
Figure 12:
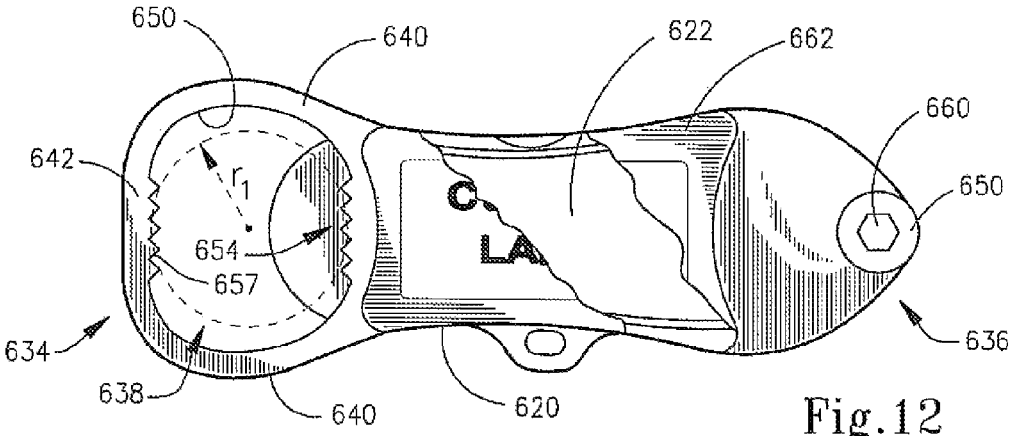
FIG. 12 is a top plan view, partially broken away, showing the ski tool according to the seventh exemplary embodiment of the present invention.
Figure 13:
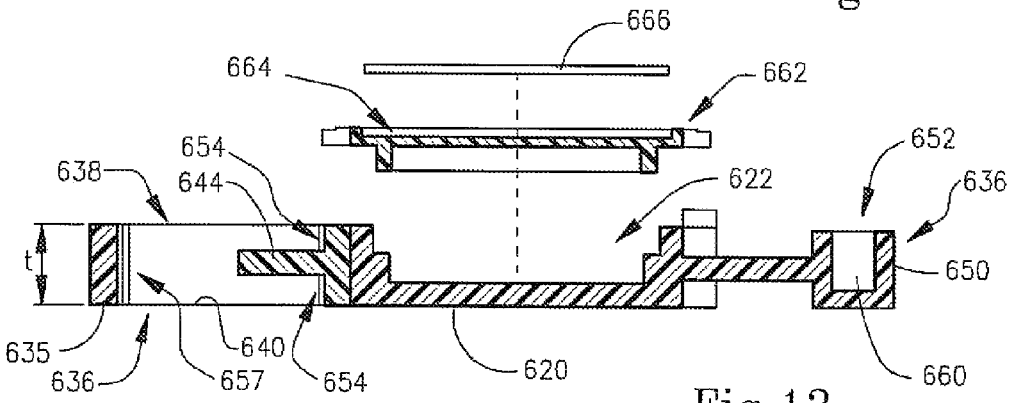
FIG. 13 is an exploded side view in cross-section of the ski tool according to the seventh exemplary embodiment of the present invention.

A seventh exemplary embodiment of the present invention is illustrated in FIGS. 11-13. Here, tool 610 has many of the features of the previous embodiments including a central base portion 620 having a compartment 622 formed therein. A first working head 634 projects longitudinally from base portion 620, and a second working head 636 projects longitudinally from base portion 620 oppositely of first working head 634.

In this exemplary embodiment, first working head 634 is formed as a generally annular member 635 that includes a pair of opposed arms 640 and a transverse distal bar 642 extending therebetween. Thus, an opening 638 is formed that is sized and adapted to receive the end of a buckle lever, such as buckle lever 16 shown in FIG. 1. A tongue 644 projects into the interior of opening 638 in order to engage the latching lever of the buckle.

Second working head 636 is formed similarly to working head 636 described with respect to the first exemplary embodiment of the present invention. Thus, working head 636 includes a cup-shaped socket 650 having a hexagonal cavity 652 formed therein and a magnet 660 disposed in cavity 652 to help secure a tool piece.

Similarly, compartment 622 is formed substantially the same as compartment 22, described above, so that a description of this structure is not here repeated. A lid 662 is provided to enclose the interior of compartment 622 and is constructed substantially similar to lid 662 described above. Here, however, lid 662 is modified to have a rectangular recess 664 formed therein with recess 664 sized and adapted to receive a rectangular label plate 666 which may be customized, for example, with a company name, logo, team name, etc. Here, label plate 666 may be mounted in recess 664 by any suitable adhesive.

As may be appreciated from FIGS. 11-13, tool 610, with the exception of lid 662 and plate 666, is formed as an integral one-piece molding of a suitable plastic material that is sufficient strength to resist breaking when in use. Examples of such materials may include any suitable plastic or glass re-enforced plastic, such as glass re-enforced nylon. In any event, with this molding, it may be seen that annular portion 635 has a thickness "t" that is the same as the thickness of the base portion 620. Moreover, suitable portions of internal sidewall 650 of annular portion 635 are provided with a plurality of tooth structures 654 and 657. As illustrated, tooth structures 654 and 657, respectively, are formed on transverse bar portion 642 and on base portion 620 along a radius "$Y_1$" which is chosen to be the diameter of a bottle cap such as commonly used on twist-off beer bottles and the like. However, the tooth structures could be formed on any combination of arms 640, bar 642 and base portion 620, as desired. Accordingly, tool 610 may be used to open such bottles whether the bottles are pry-off caps or twist-off caps.

To use as a pry-off cap opener, the user pries the cap off using leverage between bar 642 and tongue 644. For a twist-off cap, tooth structures 654 and 657 are opposed to one another so that the bottle cap may be received in annular portion 635 with tooth structures 654 and 657 engaging the crimps on the bottle cap. The user may then employ the leverage provided by tool 610 to twist off such cap.

Figure 14:
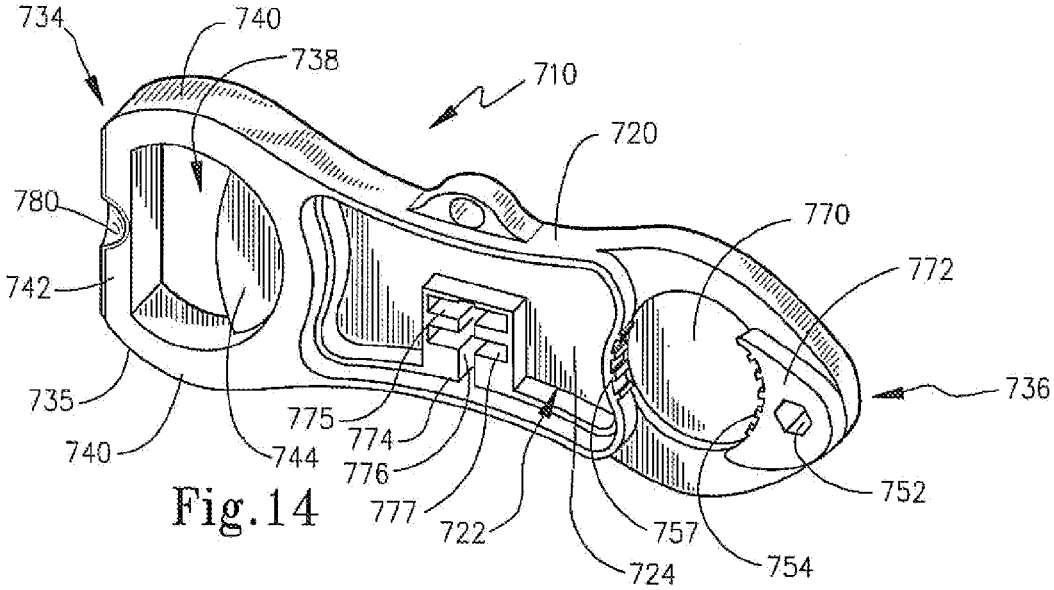
FIG. 14 is a perspective view of an eighth exemplary embodiment of the present invention as viewed from the front.
Figure 15:
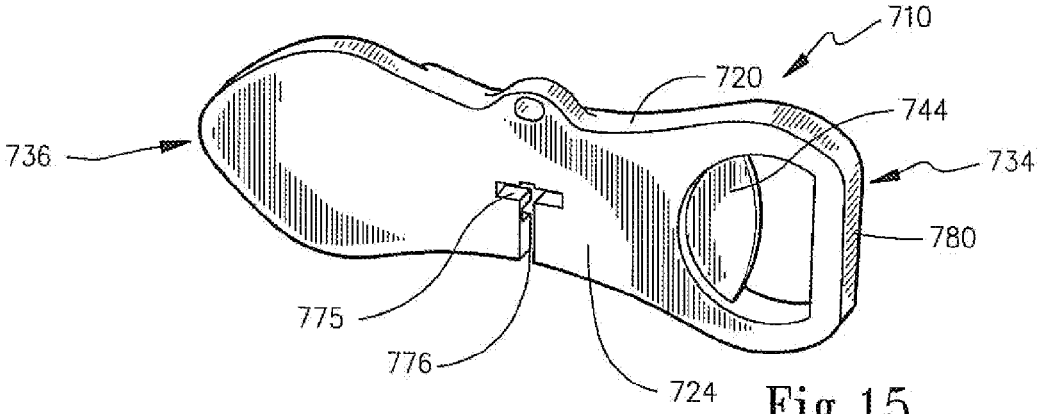
FIG. 15 is a perspective view of the eighth exemplary embodiment of the present invention as viewed from the back.
Figure 16:
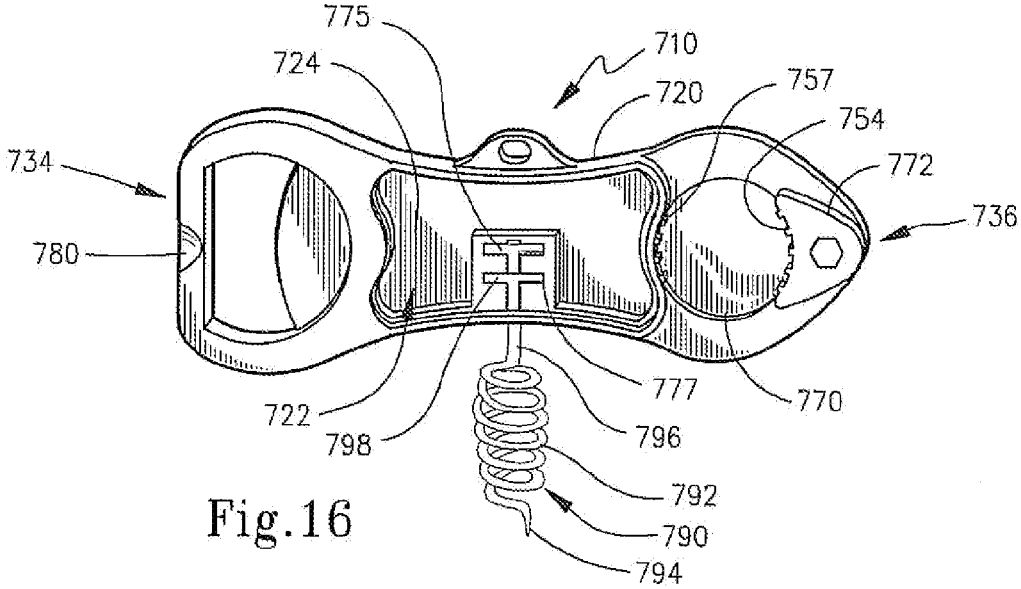
FIG. 16 is a perspective view of the eighth exemplary embodiment of the present invention having a cork screw attachment.

Finally, an eighth exemplary embodiment of the present invention is illustrated in FIGS. 14-16. Here, tool 710 has many of the features of the previous embodiments including a central base portion 720 having a compartment 722 formed therein. A first working head 734 projects longitudinally from base portion 720, and a second working head 736 projects longitudinally from base portion 720 oppositely of first working head 734.

In this exemplary embodiment, first working head 734 is formed as a generally annular, and specifically D-shaped, member 735 that includes a pair of opposed arms 740 and a transverse distal bar 742 extending therebetween. Thus, an opening 738 is formed that is sized and adapted to receive the end of a buckle lever, such as buckle levers 16 shown in FIG. 1. A tongue 744 projects into the interior of opening 738 in order to engage the latching lever of the buckle. Transverse distal bar 742 also includes a relief 780 that provides clearance for threaded rod 17 (see FIG. 1), which are commonly employed on ski boot buckles to provide fine adjustment of the buckle.

Second working head 736 is formed similarly to working head 36 described with respect to the first exemplary embodiment of the present invention. Thus, working head 736 includes a hexagonal cavity 752 formed therein and a magnet 760 (not shown) disposed in cavity 752 to help secure a tool piece. In addition, working head 736 includes a recess 770 that is provided with a plurality of toothed structures 754 and 757 disposed along a radius, as described with respect to the seventh embodiment, which is chosen to be the diameter of a bottle cap such as commonly used on twist-off beer bottles and the like. Tool 710 may, therefore, be used to open pry-off and twist-off caps in a similar fashion as is described above with reference to the seventh embodiment.

Compartment 722 is formed substantially the same as compartment 22, described above. However, in this embodiment, provisions for a corkscrew attachment are included. It should be understood that the corkscrew attachment 790 may be conveniently stowed in compartment 722 until deployment is desired. Corkscrew boss 774 is formed in the interior of compartment 722. Boss 774 includes an elongate channel 776 and two transverse channels 775 and 777. As perhaps best shown in FIG. 15, channels 776 and 775 extend through bottom wall 724 while channel 777 is blind. Corkscrew attachment 790 includes shank 796 and transverse cross-bar 798. Depending from shank 796 is a screw shaped portion 792 terminating at point 794 that is typical of conventional corkscrews.

To deploy the corkscrew attachment, the user removes attachment 790 from compartment 722 and inserts cross-bar 798 from the back of tool 710 (see FIG. 15) through channel 775. As perhaps best shown in FIG. 16, once inserted, cross-bar 798 is made to engage blind channel 777. A lid 762 (not shown) is provided to enclose the interior of compartment 722 and capture cross-bar 798 and shank 796 in the interior of compartment 722. At this point the corkscrew attachment may be used as a conventional corkscrew by twisting the screw portion 792 into a cork to be removed. Tool 710 provides the leverage for twisting the screw into the cork as well as for pulling the cork free. Because cross-bar 798 is captured in channel 777, corkscrew attachment 790 is prevented from rotating relative to tool 710. Accordingly, tool 710 may be used to open bottles whether the bottles are pry-off caps, twist-off caps, or corked bottles. It should be appreciated that, while the present embodiment is described relative to a corkscrew attachment, other attachments may be stowed in compartment 722 and deployed in a similar manner as described with respect to the corkscrew attachment.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein. Moreover, any feature of one embodiment may be incorporated into other described embodiments, as would be apparent to the skilled artisan.

We claim:

1. A tool adapted for use in opening and closing boot buckles wherein such boot buckles include a latching lever, comprising:

(A) a base portion;

(B) a first working head projecting longitudinally from said base portion, said first working head having an opening formed therein that is sized and adapted to engage an end portion of the latching lever of a boot buckle and configured to provide a tongue portion projecting longitudinally away from said base portion; and (C) a second working head projecting longitudinally from said base portion oppositely of said first working head, said second working head including a socket portion having a bore formed therethrough that is sized and adapted to receive a medial portion of a tool piece.

2. A tool according to claim 1 wherein said base portion includes an ear portion projecting therefrom with said ear portion having a hole formed therethrough that is adapted to receive a flexible cord.

3. A tool according to claim 1 including a soft grip material extending around said base portion.

4. A tool according to claim 1 wherein said base portion has a compartment formed therein with a compartment interior adapted to receive at least one tool piece therein.

5. A tool according to claim 4 wherein said compartment is formed as an elongate channel in said base portion.

6. A tool according to claim 4 including a cover member adapted to enclose said compartment when in a mounted state.

7. A tool according to claim 6 wherein said base portion includes a boss portion adapted to supportably mount a tool piece.

8. A tool according to claim 7 wherein said tool piece is a corkscrew.

9. A tool according to claim 6 wherein said compartment has an interior surrounding sidewall and is formed to include a shelf extending around said sidewall to define a seat for said cover member, said cover member including a rim wall having a rim wall edge operative to engage said seat when in the mounted state.

10. A tool according to claim 4 including at least one tool piece disposed in said compartment.

11. A tool according to claim 1 including a flexible cord secured to said base portion.

12. A tool according to claim 1 wherein said first working head is formed as a generally annular portion defining the opening so as to include a transverse bar section in opposed relation to said tongue portion.

13. A tool according to claim 12 wherein said transverse bar section includes a relief adapted to provide clearance for a portion of the boot buckle.

14. A tool according to claim 12 wherein said base portion extends generally in a longitudinal direction to define a base length, a base width transverse to the base length and a base thickness, said annular portion having a thickness that is substantially the same as the base thickness.

15. A tool according to claim 12 wherein said annular portion has an internal sidewall and including at least one tooth structure on said internal sidewall.

16. A tool according to claim 15 including a plurality of tooth structures formed in opposed relationship on said internal sidewall.

17. A tool adapted for use in opening and closing boot buckles wherein such boot buckles include a latching lever, comprising:

(A) a longitudinally extending base portion having a thickness and having a compartment formed therein with a compartment interior adapted to receive at least one tool piece therein, wherein said compartment has an interior surrounding sidewall and is formed to include a shelf extending around said sidewall to define a seat;

(B) a first working head projecting longitudinally from said base portion, said first working head having an opening formed therein that is sized and adapted to engage an end portion of the latching lever of a boot buckle and configured to provide a tongue portion projecting longitudinally away from said base portion;

(C) a second working head projecting longitudinally from said base portion oppositely of said first working head, said second working head including a socket portion adapted to supportably mount a tool piece; and (D) a cover member adapted to enclose said compartment when in a mounted state, said cover member including a central plate portion and a rim wall depending downwardly therefrom to terminate in a rim wall edge that is operative to abut said seat when in the mounted state.

18. A tool according to claim 17 wherein said second head includes a pair of opposed tooth structures.

19. A tool according to claim 17 wherein said compartment is formed as an elongate channel in said base portion.

20. A tool according to claim 17 wherein said socket portion has a cavity formed therein that is sized and adapted to receive an end portion of a tool piece.

21. A tool according to claim 20 including a magnet disposed in the cavity of said socket portion.

22. A tool according to claim 17 wherein said first working head is formed as a generally annular portion defining the opening so as to include a transverse bar section in opposed relation to said tongue portion.

23. A tool according to claim 22 wherein said base portion extends generally in a longitudinal direction to define a base length, a base width transverse to the base length and a base thickness, said annular portion having a thickness that is substantially the same as the base thickness.

24. A tool according to claim 22 wherein said annular portion has an internal sidewall and including at least one tooth structure on said internal sidewall.

25. A tool according to claim 24 including a plurality of tooth structures formed in opposed relationship on said internal sidewall.

26. A tool according to claim 17 including at least one tool piece disposed in said compartment.

27. A tool adapted for use in opening and closing boot buckles wherein such boot buckles include a latching lever, comprising:

(A) a base portion having a compartment formed therein with a compartment interior adapted to receive at least one tool piece therein, wherein said compartment has an interior surrounding sidewall and is formed to include a shelf extending around said sidewall to define a seat;

(B) a first working head projecting longitudinally from said base portion, said first working head having an opening formed therein that is sized and adapted to engage an end portion of the latching lever of a boot buckle and configured to provide a tongue portion projecting longitudinally away from said base portion; and (C) a cover member adapted to enclose said compartment when in a mounted state, said cover member including a rim wall having a rim wall edge operative to engage said seat when in the mounted state.

28. A tool according to claim 27 including a second working head projecting longitudinally from said base portion oppositely of said first working head, said second working head including a socket portion adapted to supportably mount a tool piece.

29. A tool according to claim 28 wherein said socket portion has a cavity formed therein that is sized and adapted to receive an end portion of a tool piece.

30. A tool according to claim 29 including a magnet disposed in the cavity of said socket portion.

31. A tool according to claim 28 wherein said socket portion has a bore formed therethrough that is sized and adapted to receive a medial portion of a tool piece.

32. A tool adapted for use in opening and closing boot buckles wherein such boot buckles include a latching lever, comprising:

(A) a base portion;

(B) a first working head projecting longitudinally from said base portion, said first working head having an opening formed therein that is sized and adapted to engage an end portion of the latching lever of a boot buckle and configured to provide a tongue portion projecting longitudinally away from said base portion;

(C) a second working head projecting longitudinally from said base portion oppositely of said first working head, said second working head including a socket portion having a cavity formed therein that is sized and adapted to receive an end portion of a tool piece; and (D) a magnet disposed in the cavity of said socket portion.

33. A tool adapted for use in opening and closing boot buckles wherein such boot buckles include a latching lever, comprising:

(A) a base portion;

(B) a first working head projecting longitudinally from said base portion and formed as a generally annular portion defining an opening formed therein so as to include a transverse bar section, said opening sized to engage an end portion of the latching lever of a boot buckle, wherein said annular portion has an internal sidewall and including a plurality of tooth structures formed in opposed relationship on said internal sidewall; and (C) a tongue portion projecting longitudinally away from said base portion in opposed relation to said transverse bar section.

34. A tool adapted for use in opening and closing boot buckles wherein such boot buckles include a latching lever, comprising:

(A) a longitudinally extending base portion having a thickness and having a compartment formed therein with a compartment interior adapted to receive at least one tool piece therein;

(B) a first working head projecting longitudinally from said base portion, said first working head having an opening formed therein that is sized and adapted to engage an end portion of the latching lever of a boot buckle and configured to provide a tongue portion projecting longitudinally away from said base portion;

(C) a second working head projecting longitudinally from said base portion oppositely of said first working head, said second working head including a socket portion having a cavity formed therein that is sized and adapted to receive an end portion of a tool piece; and (D) a magnet disposed in the cavity of said socket portion.

35. A tool according to claim 34 including a cover member adapted to enclose said compartment when in a mounted state.

36. A tool according to claim 35 wherein said compartment has an interior surrounding sidewall and is formed to include a shelf extending around said sidewall to define a seat for said cover member, said cover member including a central plate portion and a rim wall depending downwardly therefrom to terminate in a rim wall edge that is operative to abut said seat when in the mounted state.

37. A tool adapted for use in opening and closing boot buckles wherein such boot buckles include a latching lever, comprising:

(A) a longitudinally extending base portion having a thickness and having a compartment formed therein with a compartment interior adapted to receive at least one tool piece therein;

(B) a first working head projecting longitudinally from said base portion and formed as a generally annular portion defining an opening so as to include a transverse bar section, said opening sized to engage an end portion of the latching lever of a boot buckle and configured to provide a tongue portion projecting longitudinally away from said base portion in opposed relation to said transverse bar section, wherein said annular portion has an internal sidewall and including a plurality of tooth structures formed in opposed relationship oh said internal sidewall; and (C) a second working head projecting longitudinally from said base portion oppositely of said first working head, said second working head including a socket portion adapted to supportably mount a tool piece.

* * * * *